US006799734B1

(12) United States Patent
Hans

(10) Patent No.: US 6,799,734 B1
(45) Date of Patent: Oct. 5, 2004

(54) FUEL INJECTOR VALVE

(75) Inventor: Waldemar Hans, Bamberg (DE)

(73) Assignee: Robert Bosch GmbH, Stuttgart (DE)

( * ) Notice: Subject to any disclaimer, the term of this patent is extended or adjusted under 35 U.S.C. 154(b) by 34 days.

(21) Appl. No.: 09/868,681

(22) PCT Filed: Oct. 21, 2000

(86) PCT No.: PCT/DE00/03700

§ 371 (c)(1),
(2), (4) Date: Sep. 24, 2001

(87) PCT Pub. No.: WO01/29402

PCT Pub. Date: Apr. 26, 2001

(30) Foreign Application Priority Data

Oct. 21, 1999 (DE) ..... 199 50 761

(51) Int. Cl.[7] ..... B05B 1/30

(52) U.S. Cl. ..... 239/585.1; 239/585.5; 251/129.19; 335/257

(58) Field of Search ..... 239/585.1, 585.5; 277/916; 251/129.15, 129.19, 129.21; 335/257, 277

(56) References Cited

U.S. PATENT DOCUMENTS

| | | | | | |
|---|---|---|---|---|---|
| 4,766,405 A | | 8/1988 | Daly et al. | | |
| 4,905,962 A | * | 3/1990 | Iljin | ..... | 239/585.1 |
| 4,978,074 A | * | 12/1990 | Weinand | ..... | 239/585.1 |
| 5,114,077 A | * | 5/1992 | Cerny | ..... | 239/585.2 |
| 5,299,776 A | | 4/1994 | Brinn et al. | | |
| 6,126,094 A | * | 10/2000 | Ricco | ..... | 239/585.1 |
| 6,170,757 B1 | * | 1/2001 | Herrmann et al. | ..... | 239/88 |
| 6,367,769 B1 | * | 4/2002 | Reiter | ..... | 239/585.5 |
| 6,520,434 B1 | * | 2/2003 | Reiter | ..... | 239/585.5 |

FOREIGN PATENT DOCUMENTS

| | | |
|---|---|---|
| DE | 33 32 858 | 3/1985 |
| DE | 198 16 315 | 10/1999 |
| DE | 198 49 210 | 4/2000 |
| EP | 0 404 336 | 12/1990 |

* cited by examiner

*Primary Examiner*—Dinh Q. Nguyen
(74) *Attorney, Agent, or Firm*—Kenyon & Kenyon

(57) ABSTRACT

A fuel injector for fuel injection systems of internal combustion engines, having a valve needle which works together with a valve seat face to form a sealing seat, has an armature acting on the valve needle. The armature is movably guided on the valve needle and is damped by an elastomer ring made of an elastomer. The armature has at least one fuel channel for supplying fuel to the sealing seat. A flat supporting ring which axially supports the elastomer ring in the area of the outlet end of the fuel channel is arranged between the elastomer ring and the armature.

5 Claims, 2 Drawing Sheets

RELATED INFORMATION

FUEL INJECTOR VALVE

FIELD OF THE INVENTION

The present invention relates to a fuel injector.

BACKGROUND INFORMATION

U.S. Pat. No. 4,766,405 describes a fuel injector having a valve closing body connected to a valve needle and working together with a valve seat face designed on a valve seat body to form a sealing seat. For electromagnetic operation of the fuel injector, a solenoid works together with an armature connected in a friction-locked manner to the valve needle. An additional mass is provided in the form of a cylinder around the armature and the valve needle and is connected to the armature by an elastomer layer. One disadvantage is the complicated design featuring an additional component. The large-area elastomer ring is also a disadvantage for the variation of the magnetic field and makes it difficult for the field lines to close and thus interferes with achieving high attraction forces in the opening movement of the fuel injector.

U.S. Pat. No. 4,766,405 also describes an embodiment of a fuel injector; a cylindrical mass which is movably held and secured in position by two elastomer rings is provided around the armature and the valve needle for damping and reducing rebound. When the valve needle strikes the valve seat, this second mass can move relative to the armature and the valve needle and prevent rebounding of the valve needle. One disadvantage of the embodiment described there is the additional complexity and space required. The armature itself is not isolated and its momentum thus increases the tendency of the valve needle to rebound.

U.S. Pat. No. 5,299,776 describes a fuel injector having a valve needle and an armature which is movably guided on the valve needle and whose movement is limited by a first stop in the stroke direction of the valve needle and by a second stop against the stroke direction. Within certain limits, the axial movement play of the armature defined by the two stops results in isolation of the inert mass of the valve needle from the inert mass of the armature. This counteracts within certain limits the rebound of the valve needle from the valve seat face in closing of the fuel injector. However, since the axial position of the armature with respect to the valve needle is completely undefined due to the free mobility of the armature with respect to the valve needle, rebound pulses are prevented only to a limited extent. In particular, the design of the fuel injector known from U.S. Pat. No. 5,299,776 does not prevent the armature from striking the stop facing the valve closing body in the closing movement of the fuel injector and transmitting its momentum abruptly to the valve needle. This abrupt transfer of momentum can cause additional rebound pulses of the valve closing body.

It is also known from practice that the armature guided on the valve needle can be movably secured in its position by an elastomer ring. To do so, the armature is held between two stops, with an elastomer ring located between the armature and the bottom stop. However, then the problem arises that a bore through the armature is necessary to supply fuel to the valve seat face. The bore through the armature is provided close to the valve needle, and the valve seat side end of the bore is partially covered by the elastomer ring. This results in irregular pressure on the elastomer ring and finally the bore edges result in the destruction of the elastomer ring due to edge pressure. Furthermore, the vibrations are induced in the unsupported elastomer ring, which also contributes to destruction by the bore edges. This occurs especially at low temperatures, when the elastomer enters a rigid vitreous state.

SUMMARY OF THE INVENTION

The fuel injector according to the present invention has the advantage over the related art that the elastomer ring is supported axially over its full surface. Thus, there cannot be any edge pressure on the elastomer ring. This improves the long-term stability of the elastomer ring.

This is achieved in that the fuel injector has a flat supporting ring between the elastomer ring and the armature, supporting the elastomer ring axially over its entire surface and thus also in the area of the fuel channel.

This is achieved in that the longitudinal axis of the fuel channel is inclined to the longitudinal axis of the armnature so that the fuel channel opens radially outside the elastomer ring. In this way, the elastomer ring is also supported over its entire surface on an end face of the armature. In this embodiment, no vibration is induced in the elastomer ring by fuel flowing past it.

The supporting ring may advantageously have an integrally molded shoulder. Therefore, the elastomer ring is also supported radially and is protected from vibration induced by the fuel flowing past it. Accordingly, the end face of the armature may have a projection which provides radial protection.

A conventional inexpensive O ring may be used to advantage as the elastomer ring.

The elastomer ring may be made of an elastomer having a high internal damping and a great low-temperature elasticity.

DETAILED DESCRIPTION

Figure 1:
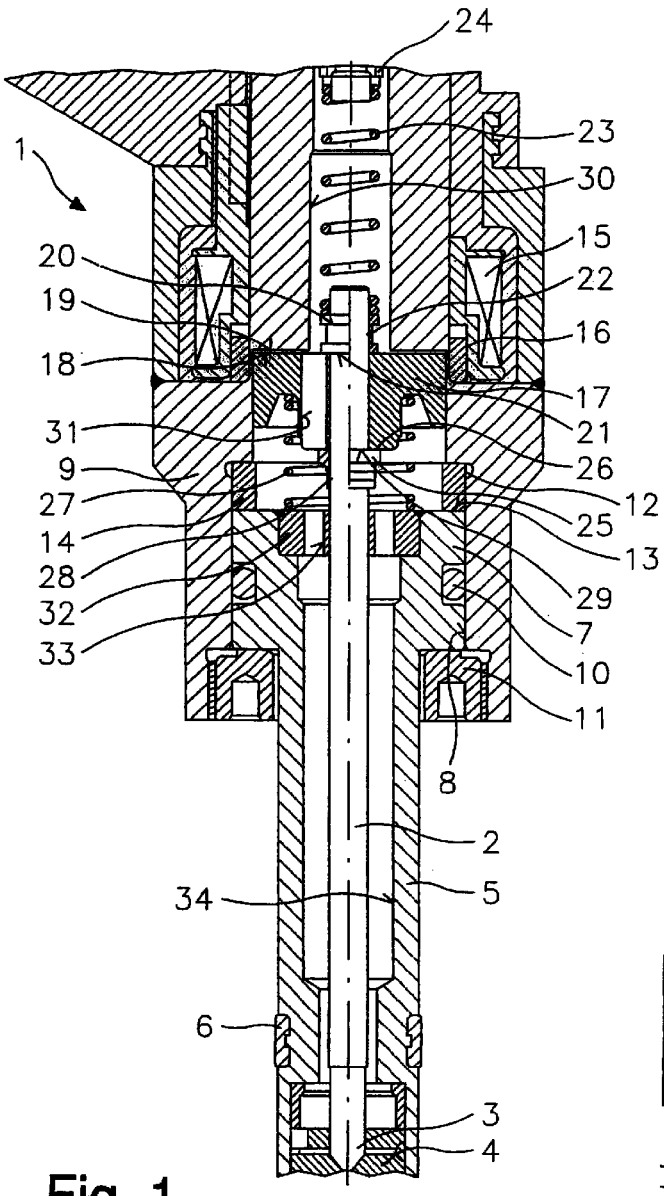
FIG. 1 shows an axial section through a generic fuel injector.

FIG. 1 shows a detail of a generic fuel injector 1 in a sectional diagram to better explain the present invention. Fuel injector 1 injects fuel into an internal combustion engine having fuel mixture compression and spark ignition. The embodiment illustrated here is a high pressure fuel injector opening inward for direct injection of fuel into the combustion chamber of the internal combustion engine.

Fuel injector 1 has a valve closing body 3 which is connected in one piece to a valve needle 2 in this embodiment and works together with a valve seat face designed on a valve seat body 4 to form a sealing seat. Valve seat body 4 is connected to a tubular valve seat carrier 5 which can be inserted into a receiving bore of a cylinder head of the internal combustion engine and is sealed with respect to the receiving bore by a gasket 6. On its inlet end 7, valve seat carrier 5 is inserted into a longitudinal bore 8 of a housing body 9 and is sealed with respect to the housing body 9 by a sealing ring 10. Inlet end 7 of valve seat carrier 5 is under pre-tension by a threaded ring 11, with a lift adjusting disk 14 clamped between a step 12 of housing body 9 and an end face 13 of inlet end 7 of valve seat carrier 5.

A solenoid 15 wound onto a coil frame 16 is used for electromagnetic actuation of fuel injector 1. When solenoid 15 is electrically energized, an armature 17 is pulled upward until its end face 19 on the inlet end is in contact with a step 18 of housing body 9. The gap width between the upstream end face 19 of armature 17 and step 18 of housing body 9 determines the valve lift of fuel injector 1. In its stroke movement, armature 17 entrains valve needle 2 which is connected to first stop body 20 and valve closing body 3 which is connected to valve needle 2 because of the contact of its upstream end face 19 with a first stop 21 provided on a first stop body 20. Valve needle 2 is welded to first stop body 20 by a weld 22. Valve needle 2 moves against a restoring spring 23 which is secured between an adjusting sleeve 24 and first stop body 20.

Fuel flows through an axial bore 30 of housing body 9 and at least one fuel channel 31, which is provided in armature 17 and is designed here as an axial bore, as well as through axial bores 33 provided in a guide disk 32, into an axial bore 34 of valve seat carrier 5 and from there to the sealing seat (not shown) of fuel injector 1.

Armature 17 is movable between first stop 21 of first stop body 20 and a second stop 26 designed on a second stop body 25, with armature 17 in this embodiment being held in contact with first stop 21 by a bearing spring 27 in the resting position, so that a gap is formed between armature 17 and second stop 26, thus permitting a certain movement play of armature 17. Second stop body 25 is secured on valve needle 2 by a weld 28.

Due to the movement play of armature 17 between stops 21 and 26, isolation between the inert masses of armature 17 and valve needle 2 with valve closing body 3 is achieved. Therefore, in the closing movement of fuel injector 1, only the inert mass of valve closing body 3 and valve needle 2 strikes against the valve seat face, in which case armature 17 is not decelerated abruptly when valve closing body 3 strikes the valve seat face, but instead it moves further in the direction of second stop 26. The isolation of armature 17 from valve needle 2 improves the dynamics of fuel injector 1. However, end face 29 of armature 17 on the spray end striking second stop 26 does not cause any valve rebound. This is achieved through an elastomer ring 35 shown in FIG. 2 between second stop body 25 and armature 17. Bearing spring 27 may optionally also be eliminated because of the damping by elastomer ring 35.

Figure 2:
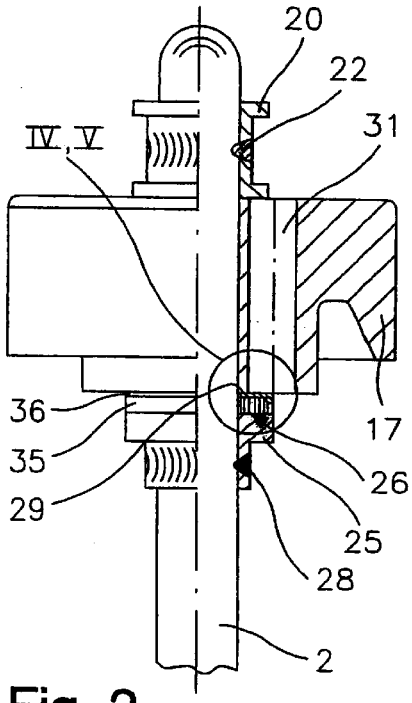
FIG. 2 shows a detail of a first embodiment of a fuel injector according to the present invention.

FIG. 2 shows a detail of armature 17 with valve needle 2 of a fuel injector according to the present invention; elements that have already been described are shown with the same reference numbers to facilitate a correlation.

The drawing shows armature 17 of fuel injector 1 according to the present invention having fuel channel 31, valve needle 2, second stop body 25 welded onto valve needle 2 by weld 28 and second stop 26, as well as end face 29 opposite second stop 26. Valve needle 2 is welded to first stop body 20 by weld 22.

Figure 4:
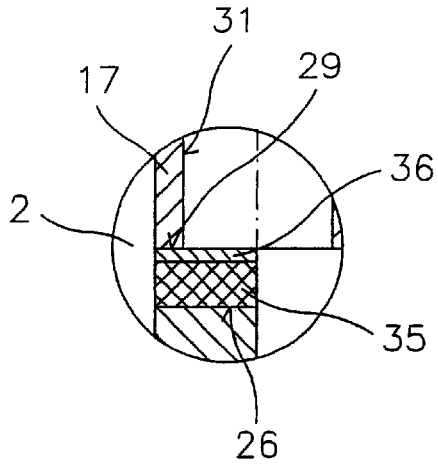
FIG. 4 shows a detail IV from FIG. 2 on an enlarged scale.

FIG. 4 shows an embodiment according to the present invention as illustrated in detail IV from FIG. 2 on an enlarged scale. Between end face 19 of armature 17 and second stop 26 there is an elastomer ring 35, a flat supporting ring 36 between elastomer ring 35 and armature 17 supporting elastomer ring 35 over its entire area, i.e., in particular also in the area of fuel channel 31, and thus preventing edge pressure at the edge of fuel channel 31.

Figure 5:
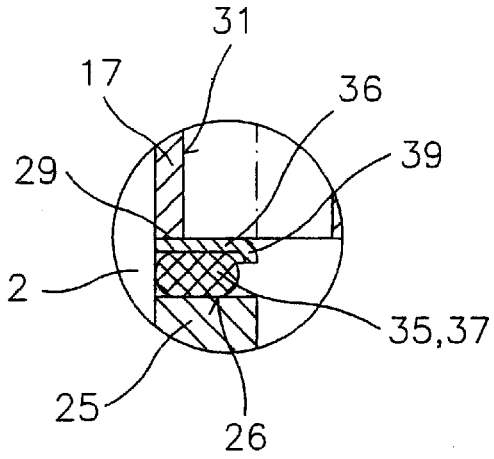
FIG. 5 shows a detail V from FIG. 2 on an enlarged scale in a modified form.

FIG. 5 shows an alternative embodiment according to the present invention as illustrated in detail V from FIG. 2 on an enlarged scale. Between end face 19 of armature 17 and second stop 26 there is an elastomer ring 35, designed as an O ring 37 in this embodiment. This O ring 37 is supported by flat supporting ring 36 over its entire area, i.e., also in the area of fuel channel 31 in particular, flat supporting ring 36 also supporting O ring 37 radially by an integrally molded, axially angled shoulder 39. Thus a commercially available component such as O ring 37 can be inexpensively used. Inducement of vibration in O ring 37 by fuel passing by it is prevented by the larger coverage of O ring 37, which also extends laterally. This counteracts destruction of elastomer ring 35 due to the edge pressure on fuel channel 31 and due to inducement of vibration.

In particular due to the radial support of O ring 37, use of an elastomer with a greater internal damping is possible. High damping by an elastomer is usually also associated with a low elasticity modulus. Since O ring 37 is protected against the forces mentioned above which shorten the lifetime of an O ring 37, such an elastomer may be used for O ring 37 without having a negative effect on the service life of O ring 37.

A low elasticity modulus of an elastomer at low temperatures usually results in an even greater sensitivity to edge pressure and inducement of vibration at the operating temperature. Therefore, in the embodiment described here as an example, it is also possible to achieve a great low-temperature elasticity of O ring 37 and thus favorable operating performance of fuel injector 1 at low temperatures, e.g., after a cold start of the engine.

Figure 3:
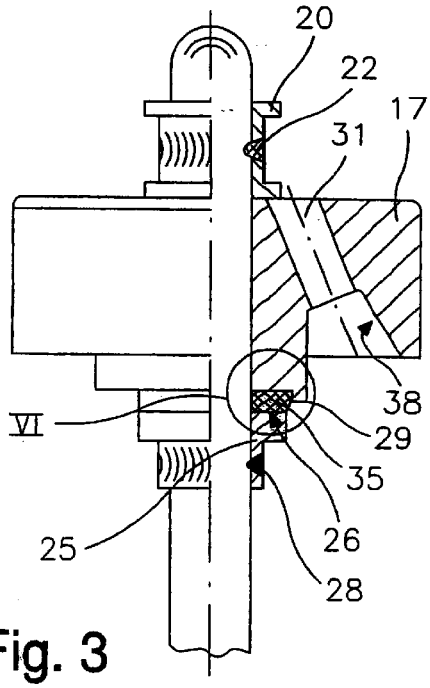
FIG. 3 shows a detail of a second embodiment of a fuel injector according to the present invention in a partially cutaway diagram.

FIG. 3 shows an enlarged detail of armature 17 and valve needle 2 of a fuel injector 1 according to another embodiment of the present invention.

FIG. 3 shows armature 17 of fuel injector 1 according to the present invention, valve needle 2, second stop body 25 welded by weld 28 onto valve needle 2 and having a second stop 26, and end face 29 of armature 17 opposite second stop 26. Valve needle 2 is welded by weld 22 to first stop body 20. The at least one fuel channel 31 opens radially outside of elastomer ring 35 because it is inclined with respect to the axis of valve needle 2.

Figure 6:
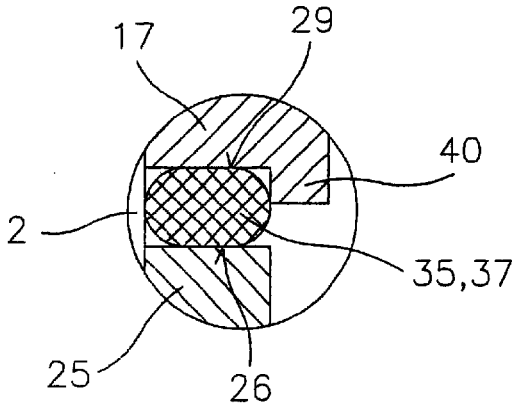
FIG. 6 shows a detail VI from FIG. 3 on an enlarged scale.

Elastomer ring 35 which is designed as O ring 37 is shown in FIG. 6 with its area facing the environment according to detail VI from FIG. 3 in an enlarged view. In the embodiment illustrated here, fuel channel 31 opens into a tangential groove 36 which accommodates bearing spring 27. This embodiment is especially advantageous because there is no inducement of vibration of O ring 37 by fuel flowing past it, and no enlargement of the diameter of armature 17 is necessary due to the inclination of fuel channel 31 to the axis of valve needle 2.

In the embodiment illustrated in FIG. 6, end face 29 of armature 17 has a projection 40. Due to the fact that O ring 37 is also covered laterally, it is possible to use an elastomer having a high internal damping and therefore a relatively low elastic modulus without any negative effect on its service life. The fact that O ring 37 is also supported radially prevents it from swelling forward and thus prevents the destruction of O ring 37 by compressive forces.

It is thus also possible to achieve a great low-temperature elasticity of O ring 37 without causing a shortened service life at the operating temperature of fuel injector 1.

What is claimed is:

1. A fuel injector, comprising:

a valve seat face;

a valve needle working together with the valve seat face to form a sealing seat;

an elastomer ring made of an elastomer;

an armature including at least one fuel channel and acting on the valve needle, the armature being movably guided on the valve needle and being damped by the elastomer ring; and a supporting ring arranged between the elastomer ring and the armature, the supporting ring axially supporting the elastomer ring in an outlet end area of the at least one fuel channel.

2. The fuel injector according to claim 1, wherein:

the fuel injector is for a fuel injection system of an internal combustion engine.

3. The fuel injector according to claim 1, wherein:

the supporting ring includes a circumferential shoulder that also supports the elastomer ring radially.

4. The fuel injector according to claim 1, wherein:

the elastomer ring is an O ring.

5. The fuel injector according to claim 1, wherein:

the elastomer ring includes an elastomer having a high degree of internal damping and a high low-temperature elasticity.

* * * * *